United States Patent [19]

Warren et al.

[11] 4,242,964

[45] Jan. 6, 1981

[54] EXPLOSIVE FUSE FOR PROJECTILE

[75] Inventors: John B. Warren, Tustin; Ernest Y. Robinson, Altadena; Robert P. Kazanjy, Irvine, all of Calif.

[73] Assignee: Ares, Inc., Port Clinton, Ohio

[21] Appl. No.: 970,760

[22] Filed: Dec. 18, 1978

[51] Int. Cl.[3] ..... F42C 1/02

[52] U.S. Cl. ..... 102/275; 102/245

[58] Field of Search ..... 102/272, 273, 274, 275, 102/244, 245, 254

[56] References Cited

U.S. PATENT DOCUMENTS

| | | | |
|---|---|---|---|
| 1,975,809 | 10/1934 | Teitscheid | 102/275 |
| 2,054,510 | 9/1936 | Remondy | 102/275 |
| 3,143,071 | 8/1964 | Arnold et al. | 102/275 X |
| 3,177,810 | 4/1965 | Kipfer | 102/245 |
| 3,351,018 | 11/1967 | Bedall | 102/275 |
| 3,786,754 | 1/1974 | Donahue et al. | 102/275 X |
| 3,807,307 | 4/1974 | Putscher et al. | 102/275 |
| 3,888,182 | 6/1975 | Breed | 102/272 |
| 4,013,013 | 3/1977 | Davis | 102/275 |

FOREIGN PATENT DOCUMENTS

| | | | |
|---|---|---|---|
| 295585 | 7/1929 | United Kingdom | 102/275 |
| 524712 | 8/1940 | United Kingdom | 102/275 |

*Primary Examiner*—David H. Brown

*Attorney, Agent, or Firm*—Allan R. Fowler

[57] ABSTRACT

A percussion type projectile nose fuse includes a generally conical fuse body having a cavity open only to the base thereof. Disposed within the cavity is a firing pin, a sleeve and a ball igniter. A fuse tip portion is defined by a weakened region, open to the fuse body exterior surface, which ruptures upon tip impact with a target, thereby causing at least partial rearward penetration of the tip into the cavity. Upon such tip penetration, the tip severs a flange on the firing pin by driving it against the sleeve, and propells the firing pin rearwardly along the sleeve and into engagement with the ball igniter. By forming the sleeve substantially longer than the length of the firing pin, a time delay before ignition, equal to the firing pin transit time, is provided. A forward opening recess formed in the apex of the tip, with a thin deformable wall thereabout, provides shock absorption so that accidental rupture of the weakened region does not occur during normal handling and loading of the projectile. The fuse is constructed of an aluminum alloy thereby permitting a relatively long fuse body to enhance the ballistic characteristics of an assembled projectile. The fuse being adapted for use in very high velocity projectiles by applying a thermally ablative material to the tip portion.

16 Claims, 5 Drawing Figures

EXPLOSIVE FUSE FOR PROJECTILE

The present invention relates to fuses for explosive projectiles and, more particularly, to delayed action percussion nose fuses.

Typical percussion projectile fuses have heretofore been of complex construction having internal mechanisms which normally require extensive machining of the fuse body interior. Such machining is usually possible only if performed from both base and nose ends of the fuse body in order to properly define an interior cavity and to maintain proper dimensional tolerances.

In addition, portions of the interior fuse mechanism can ordinarily be assembled only through the open nose or tip portion of the fuse body. Consequently, following assembly, a nose shield or cap must be installed to protect the internal mechanism from environmental conditions or damage as a result of handling and loading. The seal or seam between the fuse body and cap is usually subject to rupture or partial separation with resulting fuse deterioration.

Compared with typical percussion fuses, delayed action, or time delay fuses, usually incorporate mechanisms of even greater complexity. Consequently, they are more expensive, difficult to manufacture and more likely to malfunction after rough handling.

Fuse shape also plays an important role in the design of the projectile overall shape or envelope. For example, with regard to anti-aircraft projectiles, an important ballistic characteristic is projectile time of flight, because modern jet aircraft are capable of very high speeds. An antiaircraft gun must ordinarily lead an aircraft by large angles in order to hit it, since no trajectory corrections are made to the projectile after it leaves the barrel. These large lead angles make hitting maneuvering aircraft targets extremely difficult since the maneuvers cannot be accurately predicted and compensated for. However, with reduced projectile time of flight, a small lead angle is requied and a higher hit probability is expected.

Ballistic projectile designers have long known that, up to a limit, superior projectile ballistic time of flight characteristics may be achieved, at least in part, by increasing the projectile length to diameter ratio, for example, by elongating the fuse portion of the projectile.

If an elongated fuse is used to modify a projectile with the overall length of the projectile held nearly constant, the bourrelet (cylindrical portion) of the projectile, must be made shorter.

A short bourrelet generally decreases the stability of the projectile within the barrel and undesirably increases projectile dispersion. On the other hand, if the bourrelet length is held constant and the overall projectile length is increased by using a longer fuse, the resultant additional fuse weight tends to forwardly shift the projectile center of gravity. This may decrease the projectile in-flight stability and increase projectile dispersion.

In accordance with our invention, a fuse for a high explosive projectile includes a fuse body having means defining a cavity opening from a rearward end thereof and extending forwardly, generally along a longitudinal body axis and terminating at an end wall rearwardly of a forward end of the fuse body.

The fuse body includes means defining a weakened region (shear web) near the forward end, and adjacent of and forwardly of the end wall. The weakened region, open to an exterior surface of the body to thereby define a forward tip portion, is configured so that upon impact of the tip portion with a target, shearing of the weakened region occurs thereby enabling at least partial rearward penetration into the cavity of the tip portion.

Disposed within the cavity are means for detonating the projectile in response to said cavity penetration by the tip portion.

The means defining the weakened region includes an exterior circumferential groove formed around the fuse body forwardly of the end wall. Depth and location of the groove which can both be easily varied, for example, by machining, according to specific requirements, determined shear characteristics of the weakened region.

In an exemplary embodiment, the fuse body is constructed of a lightweight metallic alloy, thereby enabling forming of a long fuse body while enabling an assembled projectile, of which the fuse is a part, to maintain a center of gravity comparable to that obtained with heavier fuses and at the same time providing superior ballistic characteristics.

The fuse body is constructed in one piece, having no joints or seams requiring special adhesives or treatment to maintain hermeticity, nor is there a possibility of a seam rupturing due to loading and handling.

Included in the means for detonating the projectile are a steel firing pin, a steel sleeve and ignitor means all disposed within the cavity. The sleeve extends in a direction rearwardly of the end wall and terminates within the cavity. The firing pin is disposed adjacent the end wall and has a body portion disposed within the sleeve and a severable flange with a diameter larger than the inside diameter of the sleeve to prevent movement of the firing pin along the sleeve until after fuse impact. When the flange is driven against the sleeve by the tip portion as it penetrates the cavity, the flange is severed and the firing pin is driven along the sleeve.

To provide a time delay, the sleeve is formed having a length substantially longer than the firing pin body, the time delay being approximately equal to the time required for the firing pin to travel along the sleeve, after fuse tip impact. Ignitor means are disposed at a rearward end of the sleeve, for engagement by the firing pin body and, in response thereto, for detonating the projectile.

A hollow recess open to the exterior surface of the fuse body and disposed in the tip portion at the apex thereof provides means for preventing accidental rupture of shearing of the weakened region prior to projectile firing.

Heat ablating means are provided on the fuse tip to prevent thermal degradation of the fuse during high velocity flight.

The foregoing and other features and advantages will be apparent in the following specification describing the preferred embodiment of the invention, taken in conjunction with the accompanying drawings in which.

Figure 2:
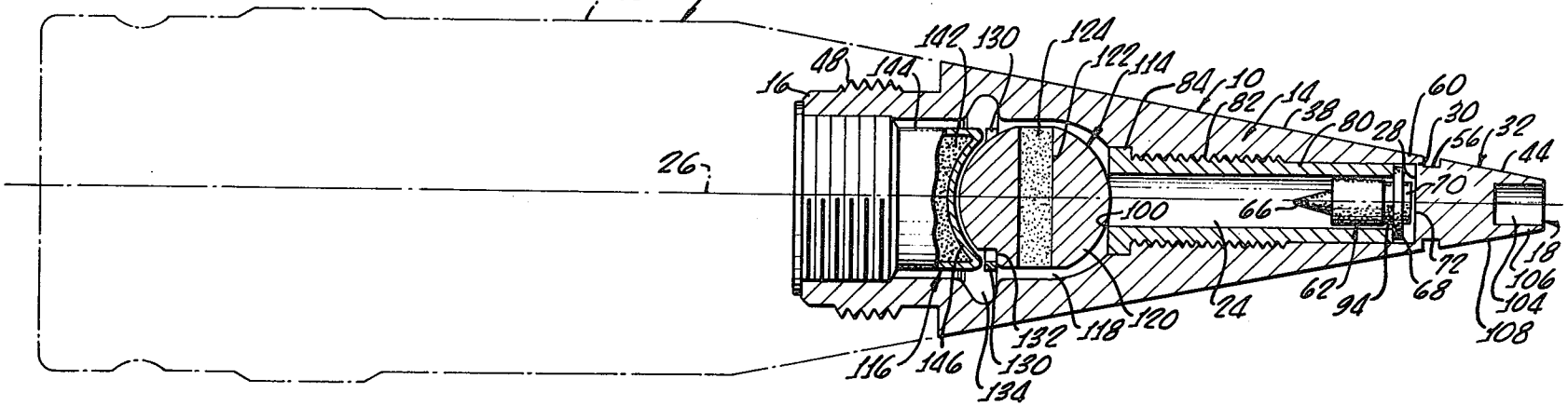
FIG. 2 is a longitudinal, cross-sectional view of the assembled unarmed percussion fuse, attached to a projectile body, showing a weakened shear region of the fuse, along with a firing pin, guide sleeve and ignitor means, all of which are disposed within a fuse body cavity.
Figure 5:
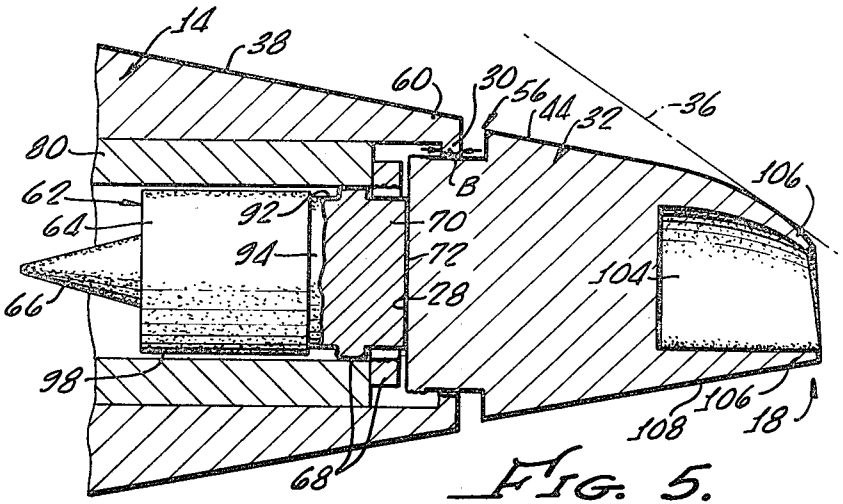
Figure 4:
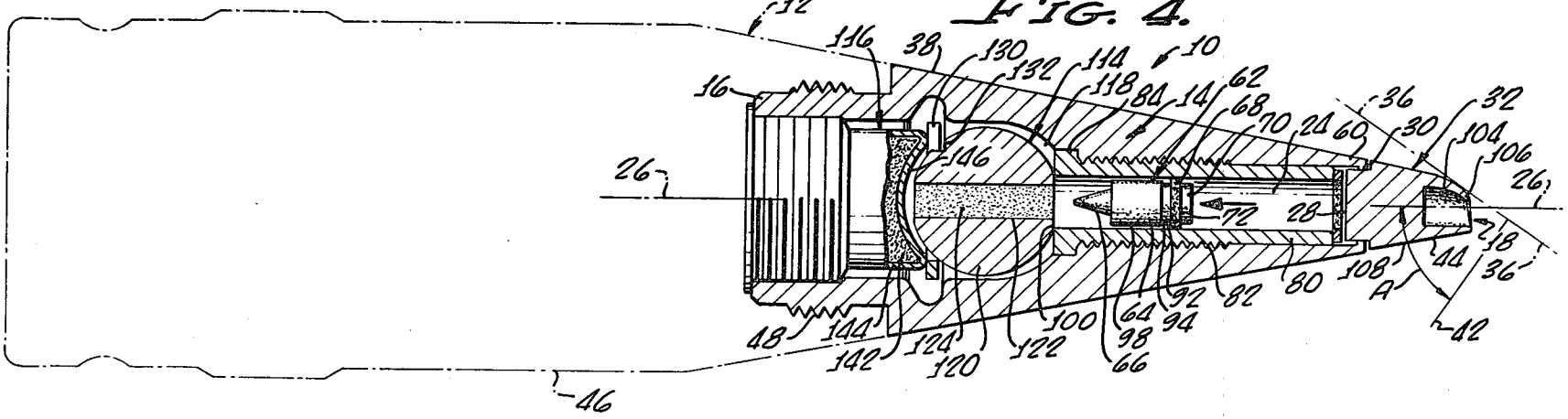

FIG. 4 is a longitudinal cross-sectional view in the plane of FIG. 2 showing the fuse armed and depicting shearing of the weakened region and subsequent driving of the firing pin along the guide sleeve after glancing impact of the fuse tip with a target; and, FIG. 5 is an enlarged sectional view in the plane of FIG. 4 showing rupturing of the weakened region in a shear mode generally parallel with the fuse axis, upon glancing fuse tip impact with a target.

Figure 1:
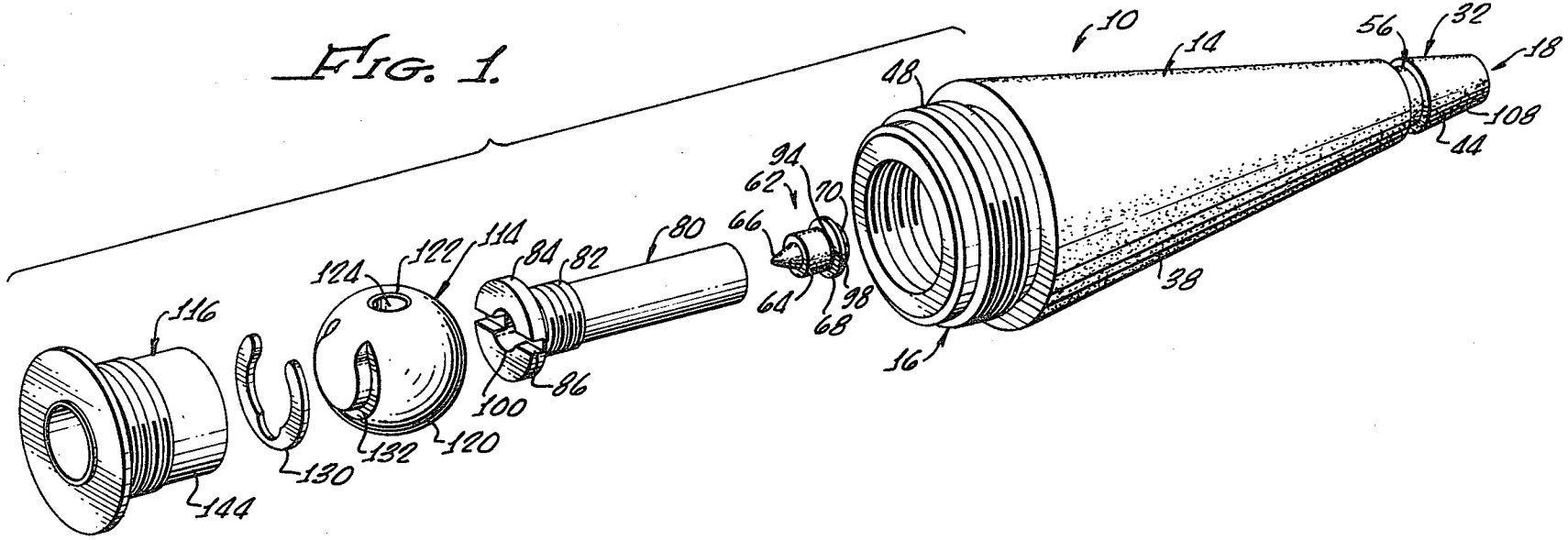
FIG. 1 is an exploded perspective view of a percussion fuse in accordance with the invention and showing elements thereof.

As shown in FIGS. 1 and 2, a fuse 10, which forms part of a high explosive projectile 12, for example, a 20 mm anti-aircraft projectile, includes a seamless, one piece, generally frusta-conical fuse body 14 having a base 16 at a rearward end and a forward or opposite end 18. Although the fuse body 14 could alternatively be constructed from more than one piece, the illustrated one piece construction insures integrity of internal fuse mechanisms without use of a separate cap and sealing materials as would otherwise be necessary.

A generally cylindrical interior fuse cavity 24, open only to the base 16, extends forwardly, generally along the longitudinal body axis 26 and terminates at a relatively flat end wall 28 (FIG. 2,3). The fuse body 14 includes means defining a shear web or weakened region 30 open to an exterior surface thereof near the forward end 18 and adjacent to, and forwardly of, the end wall 28 which also defines a forward tip portion 32.

As will be discussed subsequently in greater detail, the fuse body 14 is constructed so that upon impact of the tip portion 32 with a target 36, (FIGS. 4, 5) shearing of the weakened region 30, between such region and the end wall 28 enables at least partial rearward penetration into the cavity 24 of the tip portion 32.

For proper functioning of the fuse 10, the tip 32 must strike the target 36 before any other portion of the fuse body does. In order to assure that the tip 32 makes such initial contact with the target 36, the fuse body 14 is formed having a generally tapered, conical surface 38 and an overall length substantially greater than, for example, more than twice, its maximum diameter. With a resulting conical angle of, at most, about 30°, the tip 32 will impact the target 36 first even at very shallow angles. In other words, the tip 32 will strike the target 36 at all incident angles "A", up to approximately 85°, the incident angle "A": being measured between the longitudinal body axis 26 and a normal 42 to the target 36 (FIG. 4).

Although the generally frusto-conical configuration of the fuse body 14 enables the tip 32 to strike the target 36 even at high incident angles, the conical surface 38 for aerodynamic purposes preferable comprises an ogive which tapers towards the forward end 18. To enhance high incident angle detonation capability, a tip portion surface 44 may have a conical angle which is smaller that that of the conical surface 38, having, for example, a 24° to 26° tapered angle.

In order to maintain proper balance of the complete projectile 12, which includes the fuse 10 and a projectile body 46, that is, to maintain a center of gravity which affords proper projectile flight stability and consequently low dispersion, the fuse is preferably formed from an aluminum alloy, for example, 7075-T6 or 2024-T3. Although other alloys or materials may alternatively be used, the lightweight aluminum fuse 10 can be made substantially longer than a comparable, conventional steel fuse without displacing the projectile center of gravity. As an illustration for a 20 mm projectile and range of 1500 to 2000 meters, projectile time of flight, using the improved fuse 10, may be approximately 20% less than that of a projectile using a conventional steel fuse.

Maximum diameter of the surface 38 is equal to that of the projectile body 46 at their point of joining to provide a smooth and continuous surface transistion. The fuse 10 is firmly connected to the projectile, in a conventional manner as by a threaded fuse portion 48 at the fuse base 16.

Figure 3:
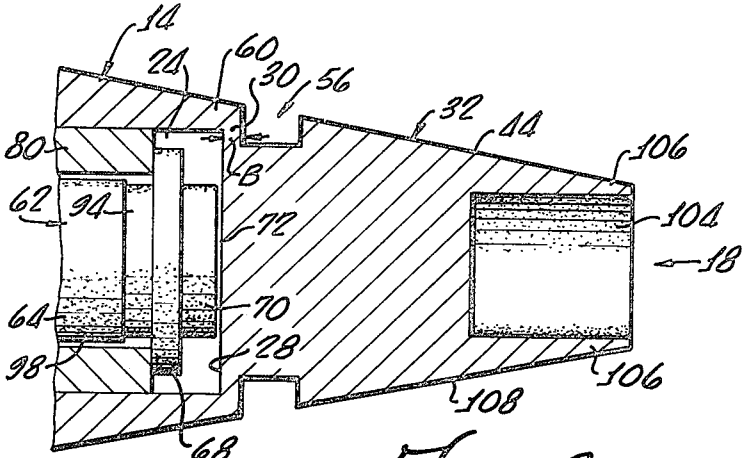
FIG. 3 is an enlarged cross-sectional view in the plane of FIG. 2, further illustrating the weakened shear region and showing means for preventing shearing of the weakened region by normal impacts caused during projectile handling and loading.

As best shown in FIG. 3, the weakened region 30 is defined or formed by interrupting or shaping the exterior surface of the fuse body, for example, cutting a circumferential groove 56 therein. Depth of the groove 56 and location thereof forwardly of the cavity 24, in part, determined the shear strength of the weakened region 30. Sensitivity of the fuse 10, is defined in terms of the amount of impact force on the tip 32 necessary for proper functioning of the fuse, that is, that impact force necessary for rupturing or shearing the weakened region 30 in the region of the end wall 28 (as described below). Accordingly, in practice depth and position of the groove 56 are varied to change a thickness "B" of the weakened region 30, and hence its shear strength, to achieve specified fuse characteristics.

By way of illustration, for a 20 mm fuse formed of 7075-T6 aluminum alloy, it has been experimentally determined that the region thickness "B" should be approximately 0.040 to 0.046 inches for proper fuse operation.

Because of ease in machining the exterior groove 56, close dimensional tolerances of the weakened region 30 can be readily obtained. Importantly, small dimensional variations in, or non concentricity of the cavity 24, as may be caused by difficulty in machining a relatively deep cavity from the fuse base 16, will not seriously affect fuse sensitivity because a fuse body wall 60, between the cavity 24 and the fuse body exterior surface 38 proximate the tip 32, is made sufficiently thick to provide greater strength than that of the weakened region 30. Stated otherwise, a slightly off center cavity 24 does not substantially affect the weakened region 30 thickness "B" and hence does not substantially affect fuse sensitivity.

An additional feature of the fuse 10 is that a variety of aluminum or other alloys, including steel, may be used for construction without major modification of the exterior shape or interior design, because fuse sensitivity, as determined by the weakened region 30 configurations, can easily be controlled by altering the position and depth of the external groove 56. Although, when heavier construction materials are used, the above described benefit of enabling a longer fuse with no change in projectile center of gravity may be diminished or lost.

Disposed within the cavity 24, adjacent the end wall 28, is a firing pin 62 (FIGS. 1, 2) preferably made of steel, having a generally cylindrical body 64, a conical firing tip 66 and a circumferential flange 68. Upon assembly, the pin 62 is coaxial with the fuse axis 26, with the conical tip 66 facing rearwardly toward the fuse base 16.

To enhance momentum transfer from the tip portion 32 to the firing pin 62 when the tip portion penetrates the cavity 24, upon target impact, as described below, a forward end 70 of the firing pin has a flat transverse engagement surface 72. Diameter of the firing pin forward end 70 is less than that of the firing pin body 64 rearwardly of the flange 68 to facilitate clean or severing of the flange 68. As is hereinafter discussed, the flange 68 must be severed, or sheared, when the fuse tip 32 impacts the target 36 to enable rearward motion of the firing pin 62 along a firing pin sleeve 80.

The sleeve 80 supports rearward portions of the firing pin 62 and retains the pin adjacent the end wall 28 by surrounding the pin body 64. The pin flange 68 has a diameter larger than inside diameter of the sleeve 80 and is configured so that the tip portion 32 upon partial penetration into the cavity 24, severs the flange by driving the flange against a forward end of the sleeve.

An outer diameter of the sleeve 80 generally conforms to the diameter of the cavity 24 proximate the tip portion 32, the sleeve being retained therein by screw threads 82 proximate a rearward sleeve head 84. A transverse slot 86 (FIG. 1) in the head 84, facilitates installation of the sleeve 80 into the cavity 24.

Inner diameter of the sleeve 80 is such as to permit passage therethrough of the firing pin 62, after the flange 68 thereof is severed or sheared off. To assure a unimpeaded passage of the firing pin 62 in spite of deformation of the aluminum fuse body 14 upon target 36 impact, the sleeve 80 is preferably formed of steel to resist deformation.

In order to enable the necessary sharp driving blow to be delivered to the firing pin 62 upon target impact, the weakened region 30 must be completely sheared before the pin flange 68 is severed. To enable this, the firing pin 62 is held loose axially within the cavity 24 by the sleeve 80. That is, the firing pin engagement surface 72 is spaced rearwardly from the generally flat end wall 28. For proper fuse operation, it has been determined that such space or clearance should be in the approximate range of 0.030 to 0.036 inches.

Upon shearing of the firing pin flange 68, passage of the firing pin 62 through the sleeve 80 has, in some instances, been found to be impeded by a slight expansion or distortion 92 (FIG. 5) which tends to be caused in the firing pin body 64, just rearwardly of the flange 68 shear region, by the shearing. To accommodate such expansion, a shallow circumferential groove 94 (FIG. 3) is formed in the pin body 64 rearwardly adjacent to the flange 68 (on the side facing the fuse base 16), the expansion occuring in the groove and not projecting beyond the fuse body diameter.

To further facilitate travel of the firing pin 62 through the sleeve 80, the pin body 64 may be coated with an approximate 0.005 inch coating 98 of such material as Teflon. Such coating 98 reduces friction between the firing pin 62 and the sleeve 80, and thus reduces the amount of driving force necessary to drive the pin through the sleeve.

A time delay, between impact of the fuse tip 32 with the target 36 and detonation of a main projectile charge (not shown) is enabled by constructing the fuse body 14 relatively long (FIG. 1). As a result, a sleeve 80 substantially longer than the firing pin 62, can be accommodated such that a short delay time is required for the pin to travel from its initial, forward position to a rearward end 100 of the sleeve 80. Depending on projectile velocity when the target 36 is impacted, the delay time thus achieved allow several inches of target penetration before projectile detonation occurs, as is ordinarily desirable to enhance destructive capability.

At least under hurried and stressful combat conditions, projectiles tend to be subjected to rough handling before and during gun loading. Consequently, the military typically requires drop tests to demonstrate that a proposed projectile can function properly and/or be safe to use after a prefiring blow on the fuse tip. For example, a 20 mm projectile must be safe to use after being subjected to a five foot drop (onto a hard surface) directly onto the nose of the fuse. Although, after such test the fuse need not function properly upon target impact, but the projectile must not prematurily detonate upon loading and firing.

To satisfy the military drop test requirements by preventing premature shearing of the weakened region 30, and thereby insure that the fuse will be safe to use after an accidental impact to the fuse, the fuse tip 32 is constructed to include impact shock absorbing means. Such means comprises a forwardly opening recess 104 (FIG. 3) having a thin deformable or collapsible wall 106 thereabout for absorbing a predetermined amount of impact shock. The wall 106 is of appropriate thickness and strength to absorb energy by deforming or collapsing upon impact before rupture of the weaker region 30. Thickness of the wall 106 and depth of the recess 104 control the amount of a shock absorption provided, and vary in dimension according to the material used for the fuse body 14, thickness of the shear web, and the weight of the complete projectile 12 and so forth.

Furthermore, in order that the fuse, when constructed of aluminum alloy, can reliably be used in projectiles designed for very high velocity, for example, greater than 4000 ft/sec, such as is normally encountered in fighter aircraft cannon mounted applications, the fuse tip 18 is preferably coated with a thermally ablative coating 108, such as Teflon. Without such thermal protection, at high velocities the aluminum alloy fuse may lose structural strength and deform due to frictional overheating in the air and thus may not function properly.

Such ablative coating should be non-brittle in order that deformation of the tip 32, including collapsing of the wall 106, will not cause the coating to shatter or separate from the tip 32.

Detonation means for the fuse 10 includes a conventional ball ignitor 14 (FIGS. 2 and 4) and booster 116 disposed within a rear portion 118 of the cavity 24. Briefly, the ball ignitor 114 consists of a steel ball 120, having an axial bore 122 filled with an impact sensitive explosive charge 124.

An expandable C-ring 130 (FIG. 1) is fitted into an off-center annular slot 132 in the ball 120 and prevents the ball from rotating within the cavity rear portion 118. The ignitor 114, within the rear cavity 118, is in an orientation in which the bore 122 is generally perpendicular to the longitudinal fuse body axis 26. In this unarmed configuration (FIG. 2), if the firing pin 62 is inadvertently driven or otherwise caused to move down the sleeve 80, it will strike only the steel ball 120 and not the explosive charge 124 and projectile ignition will not occur.

Upon firing of the projectile, however, rotational forces, caused by spin imparted to the projectile by the gun barrel, arm the fuse (FIG. 4) by causing inertial expanding and release of the C-ring 130 into a recess 134, and then causing the non-balanced ball 120 to rotate within the rear cavity 118 to an orientation aligning the bore 122 (and explosive charge 124 therein) with the fuse body axis 26. In this armed condition, upon target impact, the firing pin tip 66 will impact or engage the explosive charge 124 after being driven down the sleeve 80.

Since the explosive charge 124 is (generally) insufficient to assure ignition of the main explosive charge of the projectile, a booster explosive 116 is disposed to the rear of the ball ignitor 114. The booster 116 comprises a quantity of appropriate explosive charge 142 contained by a thin wall cup 144 which is screwed into the fuse base 16 and has a generally spherical cup wall 146, proximate the ball 120. Upon ignition of the explosive charge 124, by the firing pin 62, the wall 146 ruptures, causing subsequent ignition of the booster charge 142, which in turn fires the projectile main explosive charge (not shown).

Operation of the fuse 10 is best summarized in conjunction with FIGS. 4–5. When the projectile 12 is fired, centrifical forces, arm the fuse as above described. Upon the fuse 10 impacting the target 36, the nose wall 106 collapses, and the fuse tip 32 is immediately driven rearwardly, the weakened region 30 being sheared. Acting in a piston or hammer-like manner, the rearward end of the tip portion 32 then impacts the flat firing pin end 72. Because the firing pin 63 is not held tightly within the cavity 26, the flange 68 is not severed at the same instant the fuse weaker region 30 shears; hence, the firing pin flange 68 does not inhibit shearing of the weakened region 30.

The rearwardly moving tip 32 imparts sufficient momentum to the firing pin 62 to drive or propell it rearwardly through the sleeve 80, towards the ball ignitor 114, to cause detonation of the charge 124 upon engagement therewith.

Although there has been described hereinabove a particular arrangement of a percussion fuse in accordance with the invention for the purpose of illustrating the manner in which the invention may be used to advantage, it will be appreciated that the invention is not limited thereto. Accordingly, any and all modifications, variations or equivalent arrangements which may occur to those skilled in the art, should be considered to be within the scope of the invention as defined in the appended claims.

What is claimed is:

1. A percussion fuse for a high explosive projectile, comprising:

a fuse body including means defining a cavity opening from a rearward end thereof, and extending forwardly, generally along a longitudinal body axis and terminating at an end wall rearwardly of the forward end of the fuse body;

said body also including means defining a weakened region near said forward end, and adjacent to and forwardly of said wall;

said weakened region being open to an exterior surface of the body to thereby define a forward tip portion and being configured to shear upon impact of said tip portion with a target, thereby enabling at least partial rearward penetration of the tip portion into the cavity; and, means disposed within said cavity for causing detonation of an explosive projectile for which the fuse is connected in response to said partial cavity penetration by the tip portion.

2. The fuse of claim 1, wherein said fuse body is formed of a lightweight metallic alloy.

3. A percussion fuse for a high explosive projectile, comprising:

a fuse body including means defining a cavity opening from a rearward end thereof and extending forwardly, generally along a longitudinal body axis and terminating at an end wall short of the forward end of the fuse body;

said body also including means defining a circumferential exterior groove around the body near said forward end, adjacent to and forwardly of, said wall, thereby defining a weakened body region adjacent said wall and also defining a tip portion forwardly thereof;

said fuse body being configured to shear at said weakened region upon impact of said tip portion with a target, thereby enabling at least partial rearward penetration into the cavity by the tip portion; and, means disposed within said cavity for detonating as explosive projectile to which the fuse is connected in response to said partial cavity penetration by the tip portion.

4. A delayed action, percussion fuse for a high explosive projectile, comprising:

a fuse body including means defining a cavity opening from a rearward end thereof and extending forwardly, generally along a longitudinal body axis and terminating in an end wall short of the forward end of the fuse body;

said body being formed having a weakened region open to the exterior surface thereof, near said forward end, and adjacent to, and forwardly of, said wall to define a forward tip portion;

said fuse body being configured to shear at said weakened region, upon impact of the tip portion with a target, thereby enabling at least partial penetration into the cavity by the tip portion;

a sleeve disposed in said cavity and extending rearwardly of said end wall and terminating within the cavity;

a firing pin disposed within the cavity adjacent the end wall, and having a length substantially less than the length of the sleeve, said firing pin being configured so that partial penetration of the tip portion into the cavity in response to the fuse impacting a target causes the firing pin to be driven rearwardly along said sleeve; and, ignitor means disposed within the cavity at a rearward end of the sleeve for engagement by the rearwardly driven firing pin and, in response thereto, for detonating an explosive projectile to which the fuse is connected.

5. The fuse of claim 4, wherein the firing pin includes a body portion disposed within the sleeve and a severable flange having a diameter larger than the inside diameter of the sleeve, said flange being configured so that the tip portion, upon partial penetration into the cavity, in response to impact with a target causes shearing of said flange by driving it against the sleeve.

6. The fuse of claim 5, wherein exterior surfaces of the firing pin body are formed having a Teflon coating, passage of the firing pin along the sleeve being thereby facilitated.

7. A delayed action, percussion fuse for a high explosive projectile, comprising:

a fuse body formed of a lightweight metallic alloy, said fuse body including means defining a cavity opening from a rearward end thereof and extending fowardly, generally along a longitudinal body axis and terminating in an end wall rearwardly of a forward end of the fuse body;

said body being formed having a weakened region defined by an exterior, circumferential groove around the body near said forward end, and adjacent to, and fowardly of, said wall to thereby also define a forward tip portion;

said fuse body being configured to shear at said weakened region, upon impact of the tip portion with a target, causing at least partial penetration into the cavity of the tip portion;

a steel sleeve disposed in said cavity and extending in a direction rearwardly of said end wall and terminating within the cavity;

a steel firing pin disposed within the cavity adjacent the end wall and having a length substantially less than the length of the sleeve, said firing pin including a body portion disposed within the sleeve and a severable flange having a diameter larger than the inside diameter of the sleeve, said flange being configured so that the tip portion, upon partial penetration into the cavity in response to the fuse impacting a target, shears the flange, by driving the flange against the sleeve, and causes the firing pin to be driven along said sleeve; and, ignitor means disposed within the cavity at a rearward end of the sleeve for engagement by the firing pin body and, in response thereto, for detonating an explosive projectile to which the fuse is connected.

8. The fuse of claim 7, wherein the firing pin body includes means defining a circumferential groove thereabout adjacent a rearward side of said flange, whereby binding of the firing pin in the sleeve, after shearing of the flange, is prevented.

9. A percussion fuse for a high explosive projectile, comprising:

a fuse body including means defining a cavity opening from a rearward end thereof and extending forwardly generally along a longitudinal body axis and terminating at an end wall rearwardly of a forward end of the fuse body;

said body being formed having a weakened region defined by an exterior circumferential groove around the body, near said forward end, and adjacent to, and forwardly of, said wall to thereby also define a forward tip portion;

said fuse body being configured to shear at said weakened region upon impact of the tip portion with a target, thereby enabling at least partial penetration into the cavity of the tip portion;

said tip portion including means operative for preventing shearing of the weakened region in response to normal impacts on the tip portion during projectile handling and loading; and, means disposed within said cavity for causing detonation of an explosive projectile to which the fuse is connected in response to said cavity partial penetration by the tip portion.

10. The fuse of claim 9, wherein said means operative for preventing shearing of the fuse body from normal impacts on the tip portion during handling and loading includes a deformable collapsible tip portion disposed forwardly of said end wall.

11. The fuse of claim 10, wherein said deformable tip portion is defined by a forwardly opening recess, open to the exterior surface of the fuse body and disposed at the forward end of the tip portion.

12. A percussion fuse for a high explosive projectile, comprising:

a lightweight metallic fuse body, including means defining a cavity opening from a rearward end thereof and extending forwardly, generally along a longitudinal body axis and terminating at an end wall rearwardly of a forward end of the fuse body;

said body being formed having a weakened region defined by an exterior groove forward around the body near said forward end, and adjacent to, and forwardly of, said wall, thereby also defining a forward tip portion;

said fuse body being configured to shear at said weakened region upon impact of said tip portion with a target, thereby causing at least partial penetration into the cavity of the tip portion;

said tip portion including heat ablating means for thermally protecting the fuse during high velocity flight; and, means disposed within said cavity for causing detonating an explosive projectile to which the fuse is connected in response to said cavity penetration by the tip portion.

13. A percussion fuse for a high explosive projectile, comprising:

a fuse body having a forward tip and a base portion, said tip portion including shock absorbing means configurated to absorb a predetermined amount of impact;

said body being formed having a shear web defined by an exterior circumferential groove forwardly around the body rearwardly of said tip portion;

said body including a cavity opening from the base portion and extending forwardly generally along a longitudinal body axis and terminating at an end wall adjacent said weakened region;

said fuse body being configured to shear at said weakened region upon tip portion impact which exceeds said predetermined amount of impact, thereby causing at least partial penetration into the cavity of the tip portion; and, means disposed within said cavity for causing detonation of an explosive projectile to which the fuse is connected in response to said cavity penetration by the tip portion.

14. A delayed action, percussion fuse for a high explosive projectile, comprising:

a fuse body having a forward tip and a base portion, said tip portion including shock absorbing means for absorbing a predetermined amount of impact;

said body being formed having a weakened region defined by an exterior circumferential groove formed around the body rearwardly of said tip portion;

said body including a cavity opening from the base portion and extending forwardly generally along the longitudinal body axis and terminating at an end wall adjacent said weakened region;

said fuse body being configured to shear at said weakened region upon tip portion impact which exceeds said predetermined amount of impact, thereby causing at least partial penetration into the cavity of the tip portion;

a sleeve disposed in said cavity and extending in a direction rearwardly of said end wall and terminating within the cavity;

a firing pin disposed within the cavity adjacent the end wall and having a length substantially less than the length of the sleeve, said firing pin being configured so that partial penetration by the tip portion into the cavity causes the firing pin to be driven along said sleeve;

ignitor means disposed within the cavity at a rearward end of the sleeve for engagement by the firing pin when the firing pin is driven along the sleeve and, in response thereto, for causing detonation of an explosive projectile to which the fuse is connected.

15. The fuse of claim 14, wherein the firing pin includes a body portion disposed within the sleeve and a severable flange having a diameter larger than the diameter of the inside diameter of the sleeve, said flange being configured so that the tip portion, upon partial penetration into the cavity causes shearing of said flange by driving it against the sleeve.

16. The fuse of claim 15, wherein the firing pin body is formed having a Teflon coasting, whereby passage of the firing pin along the sleeve is facilitated.

* * * * *